US012662828B2

(12) United States Patent
Utsugi et al.

(10) Patent No.: US 12,662,828 B2
(45) Date of Patent: Jun. 23, 2026

(54) BINDING MACHINE

(71) Applicant: Max Co., Ltd., Tokyo (JP)

(72) Inventors: Masato Utsugi, Tokyo (JP); Shinpei Sugihara, Tokyo (JP)

(73) Assignee: Max Co., Ltd., Tokyo (JP)

( * ) Notice: Subject to any disclaimer, the term of this patent is extended or adjusted under 35 U.S.C. 154(b) by 240 days.

(21) Appl. No.: 18/741,300

(22) Filed: Jun. 12, 2024

(65) Prior Publication Data

US 2024/0416408 A1 Dec. 19, 2024

(30) Foreign Application Priority Data

Jun. 13, 2023 (JP) ..... 2023-096665

(51) Int. Cl.
*E04G 21/12* (2006.01)
*B21F 15/04* (2006.01)

(52) U.S. Cl.
CPC ..... *E04G 21/123* (2013.01); *B21F 15/04* (2013.01)

(58) Field of Classification Search
CPC ..... E04G 21/123; B21F 15/04
See application file for complete search history.

(56) References Cited

U.S. PATENT DOCUMENTS

| | | | | |
|---|---|---|---|---|
| 10,048,066 | B2 | 8/2018 | Lammel et al. | |
| 10,401,895 | B2 | 9/2019 | Yamaguchi | |
| 10,590,666 | B2 | 3/2020 | Itagaki et al. | |
| 11,946,267 | B2 * | 4/2024 | Itagaki | B65B 13/025 |
| 2018/0148943 | A1 | 5/2018 | Itagaki et al. | |
| 2020/0378140 | A1 | 12/2020 | Itagaki et al. | |
| 2022/0034110 | A1 * | 2/2022 | Morimura | E04G 21/123 |
| 2022/0220755 | A1 | 7/2022 | Itagaki et al. | |

FOREIGN PATENT DOCUMENTS

| | | | |
|---|---|---|---|
| JP | H09201781 | A * | 8/1997 |
| JP | 2020136023 | A | 8/2020 |
| JP | 6791141 | B2 | 11/2020 |

OTHER PUBLICATIONS

Oct. 8, 2024—(EP) Extended Search Report—App 24181960.6.

* cited by examiner

*Primary Examiner* — Atul P. Khare
(74) *Attorney, Agent, or Firm* — Banner & Witcoff, Ltd.

(57) ABSTRACT

There is provided a binding machine including: an operation dial configured to receive an operation of rotating the operation dial; a rotary switch having a rotatable shaft; and a connecting portion connecting the shaft and the operation dial such that the shaft is rotatable, the connecting portion supporting the operation dial such that a posture of the operation dial is changeable with respect to an extending direction of the shaft.

8 Claims, 6 Drawing Sheets

BINDING MACHINE

CROSS-REFERENCE TO RELATED APPLICATIONS

This application is based on and claims priority under 35 USC 119 from Japanese Patent Application No. 2023-096665 filed on Jun. 13, 2023, the contents of which are incorporated herein by reference.

TECHNICAL FIELD

The present disclosure relates to a binding machine that binds an object to be bound such as a reinforcing bar with a wire.

BACKGROUND ART

Reinforcing bars are used in concrete structures to improve strength, and are bound with wires to be prevented from deviating from prescribed positions during concrete pouring.

In the related art, there is proposed a binding machine referred to as a reinforcing bar binding machine that winds a wire around two or more reinforcing bars and twists the wire wound around the reinforcing bars to bind the two or more reinforcing bars with the wire (for example, see JP6791141B).

There is further proposed a binding machine provided with an operation unit configured to set, for example, a magnitude of a force for twisting a wire. In the binding machine, the operation unit includes a rotatable dial.

As a dial operation switch device, there is proposed a device including a dial knob configured to be rotatably operated by a user, a rotary switch having a rotatable rotor shaft, a rotor fitted to the dial knob and configured to rotate integrally with the dial knob, and a relay member coupling the rotor and the rotor shaft of the rotary switch and configured to transmit a rotational force of the rotor to the rotor shaft (for example, see JP2020-136023A).

In the dial operation switch device in the related art, when axial centers of the dial knob and the rotor and an axial center of the rotor shaft of the rotary switch deviate or incline, it is difficult to assemble the dial knob and the rotor and the rotor shaft of the rotary switch, and a load is applied to the rotor shaft of the rotary switch. For this reason, it is necessary to align the axial centers of the dial knob and the rotor and the axial center of the rotor shaft of the rotary switch.

SUMMARY OF INVENTION

The present disclosure provides a binding machine that can eliminate necessity of aligning an axial center of an operation dial and an axial center of a rotary switch.

According to an illustrative aspect of the present disclosure, a binding machine includes: an operation dial configured to receive an operation of rotating the operation dial; a rotary switch having a rotatable shaft; and a connecting portion connecting the shaft and the operation dial such that the shaft is rotatable, the connecting portion supporting the operation dial such that a posture of the operation dial is changeable with respect to an extending direction of the shaft.

According to another illustrative aspect of the present disclosure, the operation dial and a shaft of the rotary switch can relatively move a direction inclined to an extending direction of the shaft, a direction orthogonal to the extending direction of the shaft, and a direction extending along the extending direction of the shaft.

According to the present disclosure, the connecting portion can absorb deviations and inclinations between the axial centers of the operation dial and the rotary switch. Accordingly, assembly is possible even when the axial center of the rotary switch deviates from the axial center of the operation dial. Assembly is also possible even when the shaft of the rotary switch and the operation dial are not perpendicular. Further, a load applied to the shaft of the rotary switch can be prevented.

DESCRIPTION OF EMBODIMENTS

Hereinafter, an example of a reinforcing bar binding machine according to an embodiment of a binding machine of the present disclosure will be described with reference to the drawings.

Figure 1:
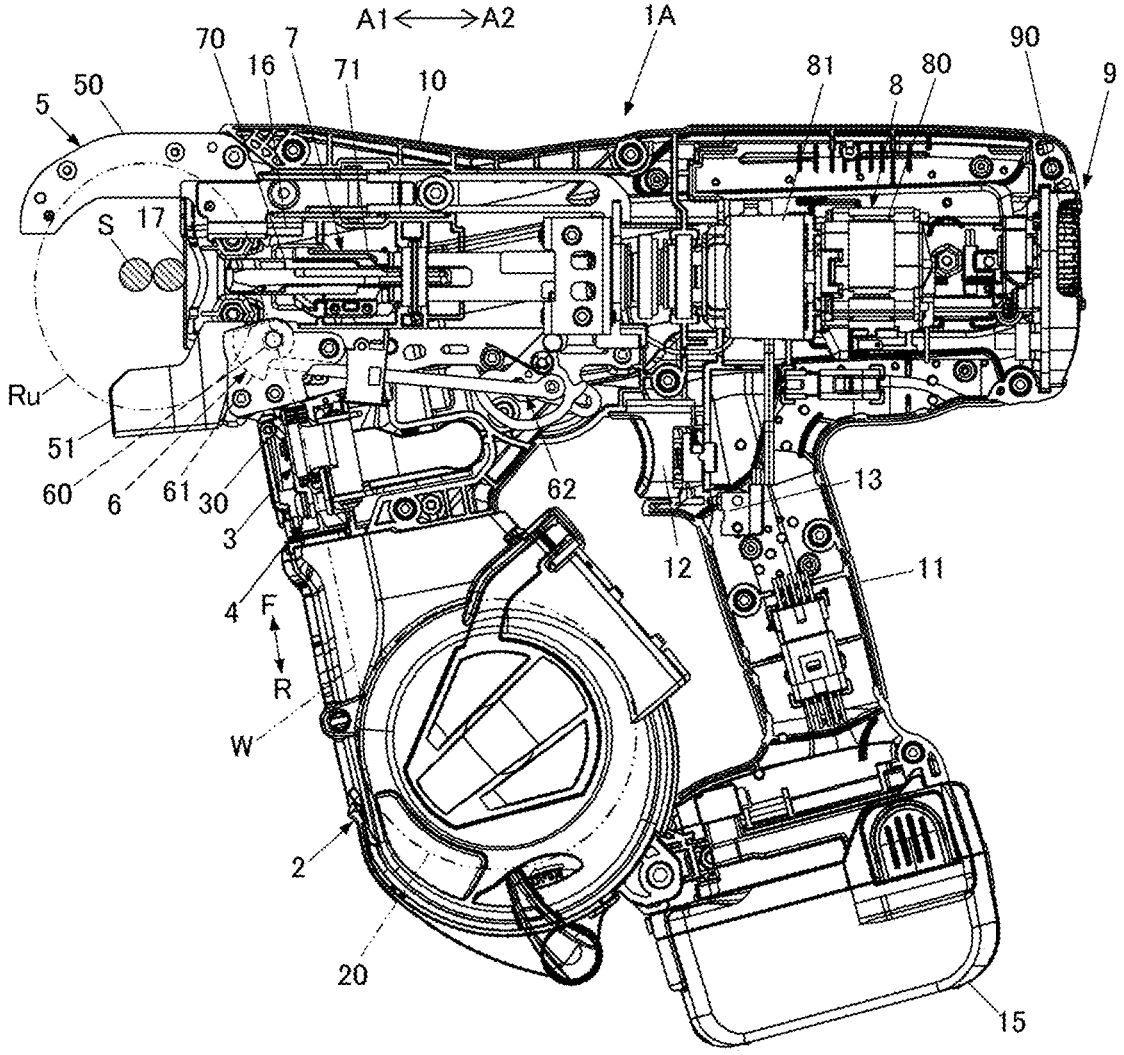
FIG. 1 is an internal configuration view seen from a side that illustrates an example of an overall configuration of a reinforcing bar binding machine according to an embodiment.
Figure 2:
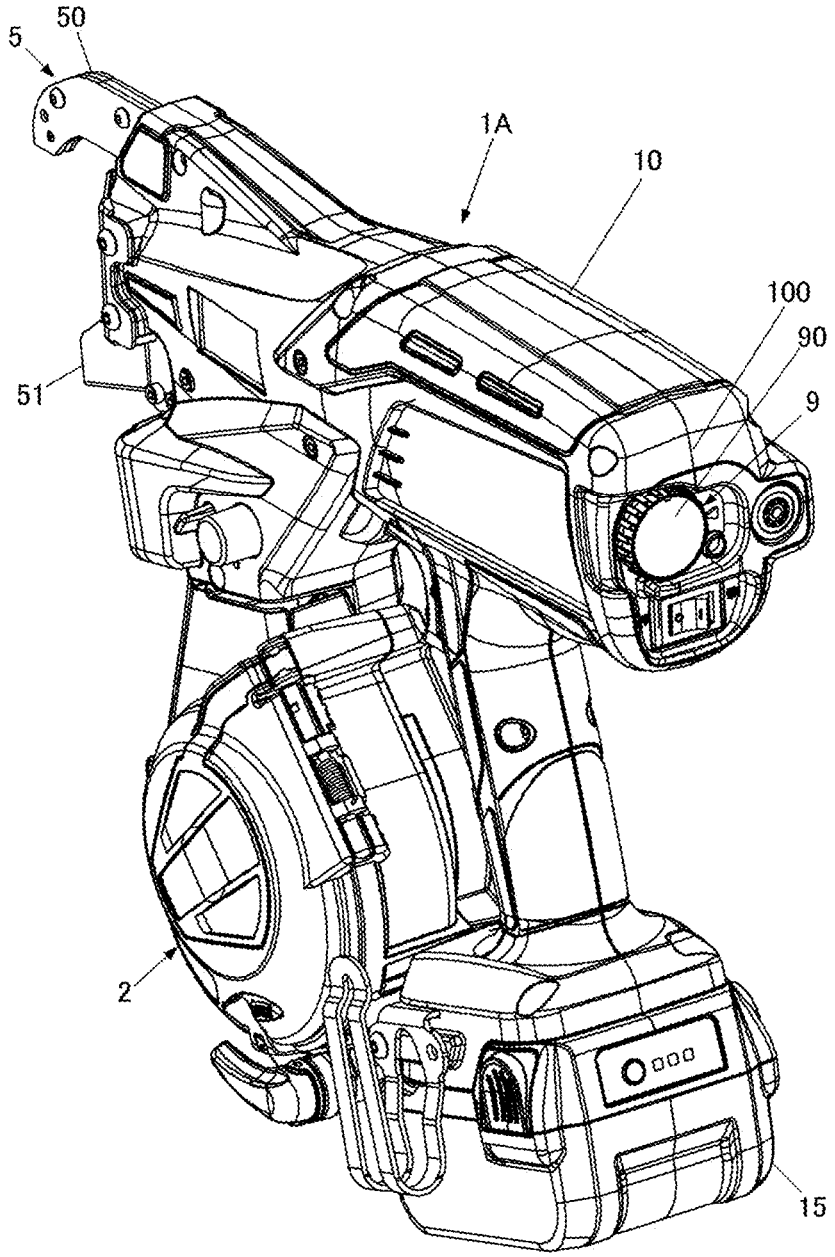
FIG. 2 is an external perspective view illustrating the example of the overall configuration of the reinforcing bar binding machine according to the present embodiment.

Configuration Example of Reinforcing Bar Binding Machine According to Present Embodiment FIG. 1 is an external configuration view seen from a side that illustrates an example of an overall configuration of the reinforcing bar binding machine according to the present embodiment. FIG. 2 is an external perspective view illustrating the example of the overall configuration of the reinforcing bar binding machine according to the present embodiment.

A reinforcing bar binding machine 1A is used by an operator holding it in a hand and includes a body 10 and a handle 11. The reinforcing bar binding machine 1A feeds a wire W in a forward direction indicated by an arrow F, winds the wire W around reinforcing bars S that are objects to be bound, feeds the wire W wound around the reinforcing bars S in a reverse direction indicated by an arrow R, winds the wire W around the reinforcing bars S, and then twists the wire W to bind the reinforcing bars S with the wire W. The reinforcing bar binding machine 1A binds the reinforcing bars S with a plurality of wires W, and in this example, two wires W.

In order to implement the above-described functions, the reinforcing bar binding machine 1A includes a magazine 2 in which the wires W are accommodated, a wire feeder 3 that feeds the two wires W side by side in a radial direction of the wires W, and a wire guide 4 that guides the two wires W fed to the wire feeder 3. The reinforcing bar binding machine 1A further includes a curl forming unit 5 that forms an annular feeding path for winding the two wires W fed by the wire feeder 3 around the reinforcing bars S, and a cutter 6 that cuts the two wires W wound around the reinforcing bars S. The reinforcing bar binding machine 1A further includes a binding unit 7 that twists the two wires W wound around the reinforcing bars S, and a drive unit 8 that drives the binding unit 7. The reinforcing bar binding machine 1A further includes an operation unit 9 configured to set, for example, a magnitude of a binding force for twisting and tying the wires W.

The magazine 2 houses a reel 20 in a rotatable and detachable manner, on which the elongated wires W are wound to be fed out. Examples of the wires W include wires formed of plastically deformable metal wires, wires having metal wires covered with resins, or stranded wires. The two wires W are wound around the reel 20, and can be pulled out from the reel 20 at the same time.

The wire feeder 3 includes a pair of feeding gears 30 that sandwich and feed the two wires W side by side. In the wire feeder 3, rotation of a feeding motor (not illustrated) is transmitted to one of the pair of feeding gears 30. In the pair of feeding gears 30, rotation of one feeding gear 30 is transmitted to the other feeding gear 30 by gear meshing.

The wire feeder 3 arranges the two wires W side by side along a direction in which the pair of feeding gears 30 are arranged side by side. In the wire feeder 3, rotation directions of the feeding gears 30 are switched by switching forward and reverse rotation directions of the feeding motor (not illustrated), and forward and reverse feeding directions of the wires W are switched.

The wire guide 4 is disposed upstream and downstream (not illustrated) of the feeding gears 30 in the forward feeding direction of the wires W. The wire guide 4 arranges the two entered wires W along the direction in which the pair of feeding gears 30 are arranged side by side, and guides the wires W to between the pair of feeding gears 30.

The curl forming unit 5 includes a curl guide 50 that curls the two wires W fed by the wire feeder 3 and restricts an orientation in which the two wires W are arranged side by side, and an introducing guide 51 that introduces the two wires W curled by the curl guide 50 to the binding unit 7. The curl forming unit 5 curls the two wires W fed by the wire feeder 3 and passing through the curl guide 50, so that an annular feeding path Ru from the curl guide 50 to the binding unit 7 through the introducing guide 51 as illustrated by two-dot chain lines in FIG. 1 is formed.

The cutter 6 includes a fixed blade 60, a movable blade 61 that cuts the wires W in cooperation with the fixed blade 60, and a transmission mechanism 62 that transmits an operation of the binding unit 7 to the movable blade 61. The cutter 6 cuts the wires W by rotation of the movable blade 61 with the fixed blade 60 as a fulcrum shaft.

The binding unit 7 includes a wire locking body 70 to which the wires W are locked, and a sleeve 71 that actuates the wire locking body 70. The drive unit 8 includes a motor 80 and a speed reducer 81 that performs speed reduction and torque amplification.

The reinforcing bar binding machine 1A includes, at an end of a feeding path of the wires W passing through the annular feeding path Ru and locked by the wire locking body 70, a feeding restrictor 16 against which distal ends of the wires W abut. In the reinforcing bar binding machine 1A, the curl guide 50 and the introducing guide 51 of the curl forming unit 5 are provided at a front end of the body 10. The reinforcing bar binding machine 1A is further provided with, between the curl guide 50 and the introducing guide 51 at the front end of the body 10, an abutting portion 17 against which the reinforcing bars S abut.

In the reinforcing bar binding machine 1A, the handle 11 extends downward from the body 10. A battery 15 is detachably attached to a lower portion of the handle 11. In the reinforcing bar binding machine 1A, the magazine 2 is provided in front of the handle 11. In the reinforcing bar binding machine 1A, the wire feeder 3, the cutter 6, the binding unit 7, the drive unit 8 that drives the binding unit 7, and the like are housed in the body 10.

In the reinforcing bar binding machine 1A, a trigger 12 is provided on a front side of the handle 11, and a switch 13 is provided inside the handle 11. The reinforcing bar binding machine 1A controls the feeding motor (not illustrated) and the motor 80 by a controller in accordance with a state of the switch 13 pressed by an operation of the trigger 12.

Configuration Example of Operation Unit According to Present Embodiment

Figure 3:
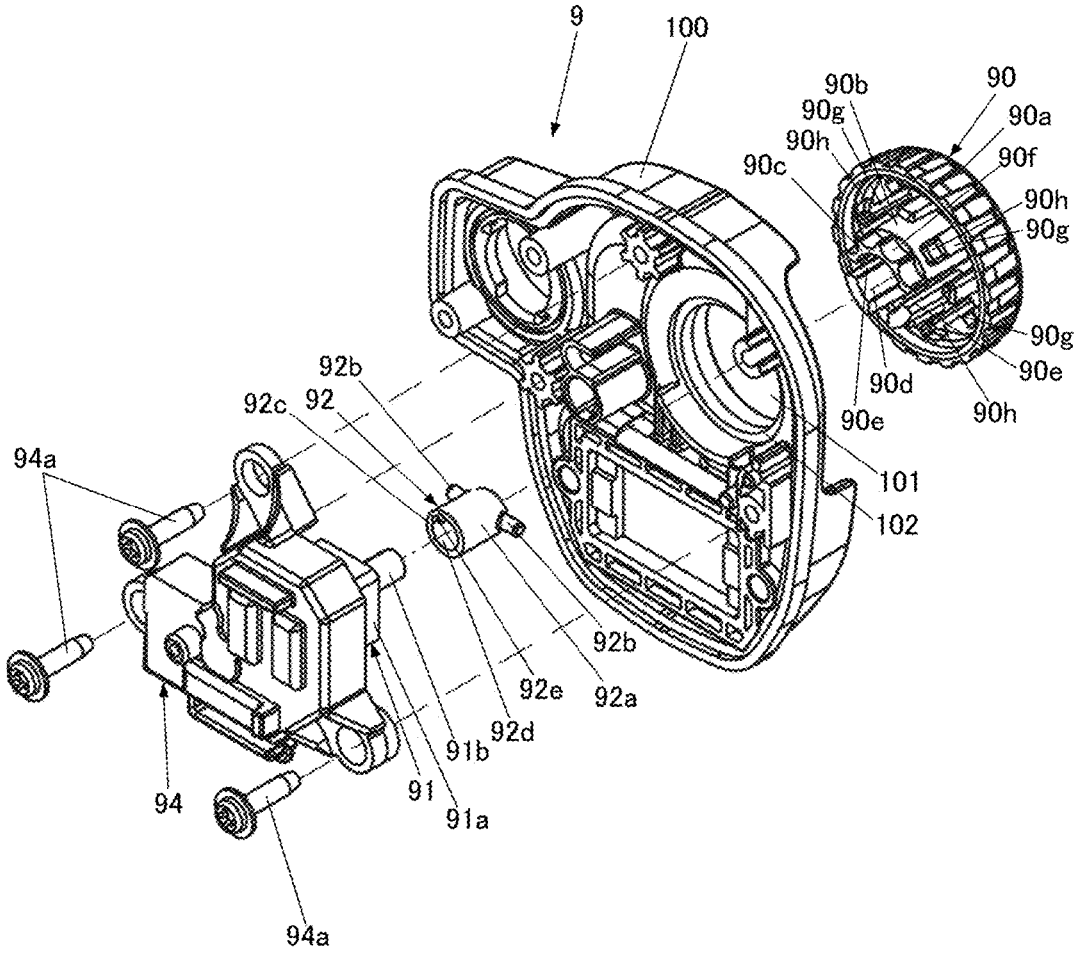
FIG. 3 is an exploded perspective view illustrating an example of an operation unit according to the present embodiment.
Figure 4A:
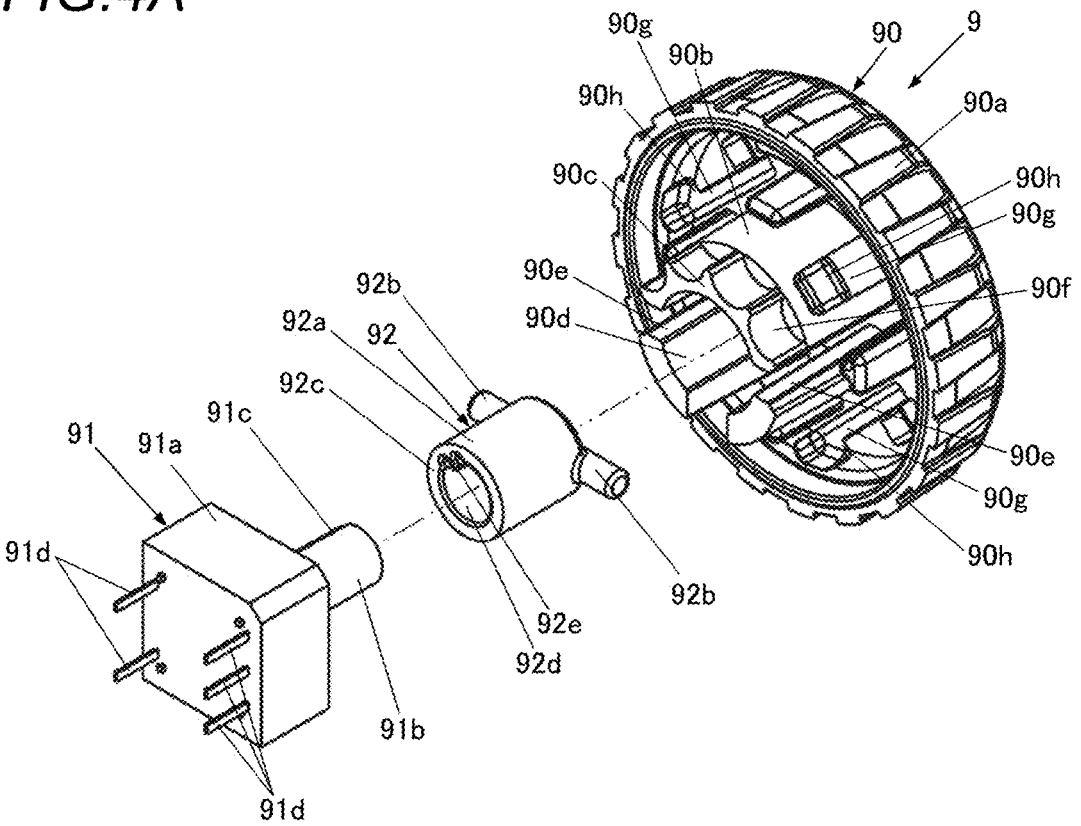
FIG. 4A is an exploded perspective view of a main portion illustrating the example of the operation unit according to the present embodiment.
Figure 4B:
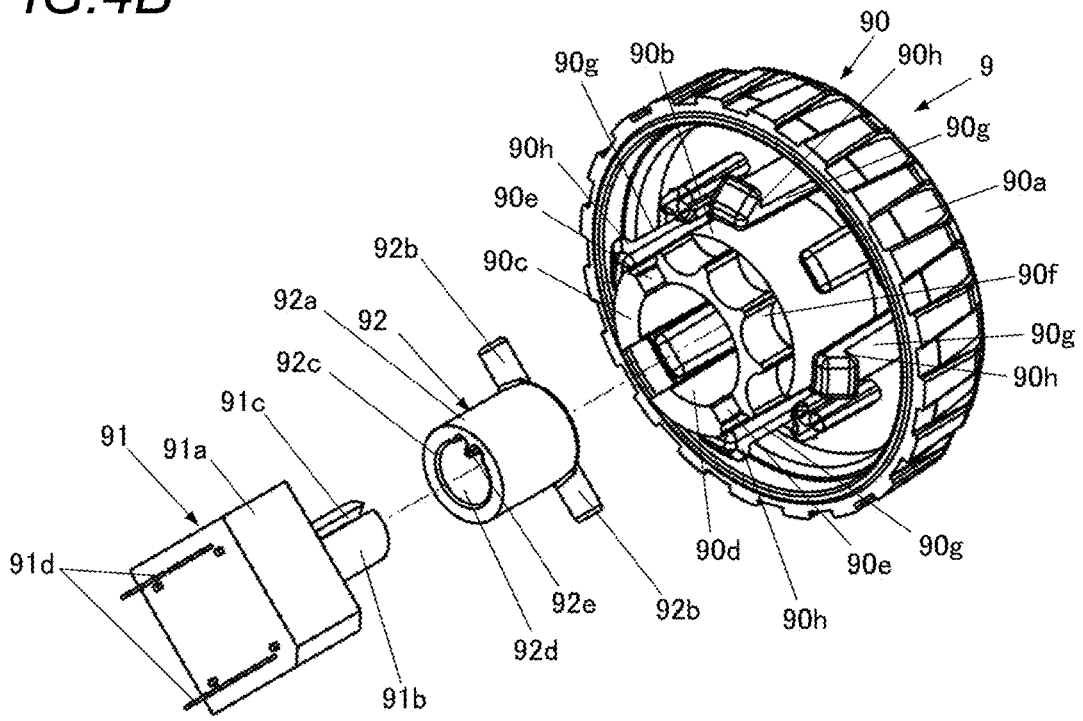
FIG. 4B is an exploded perspective view of a main portion illustrating the example of the operation unit according to the present embodiment.
Figure 5A:
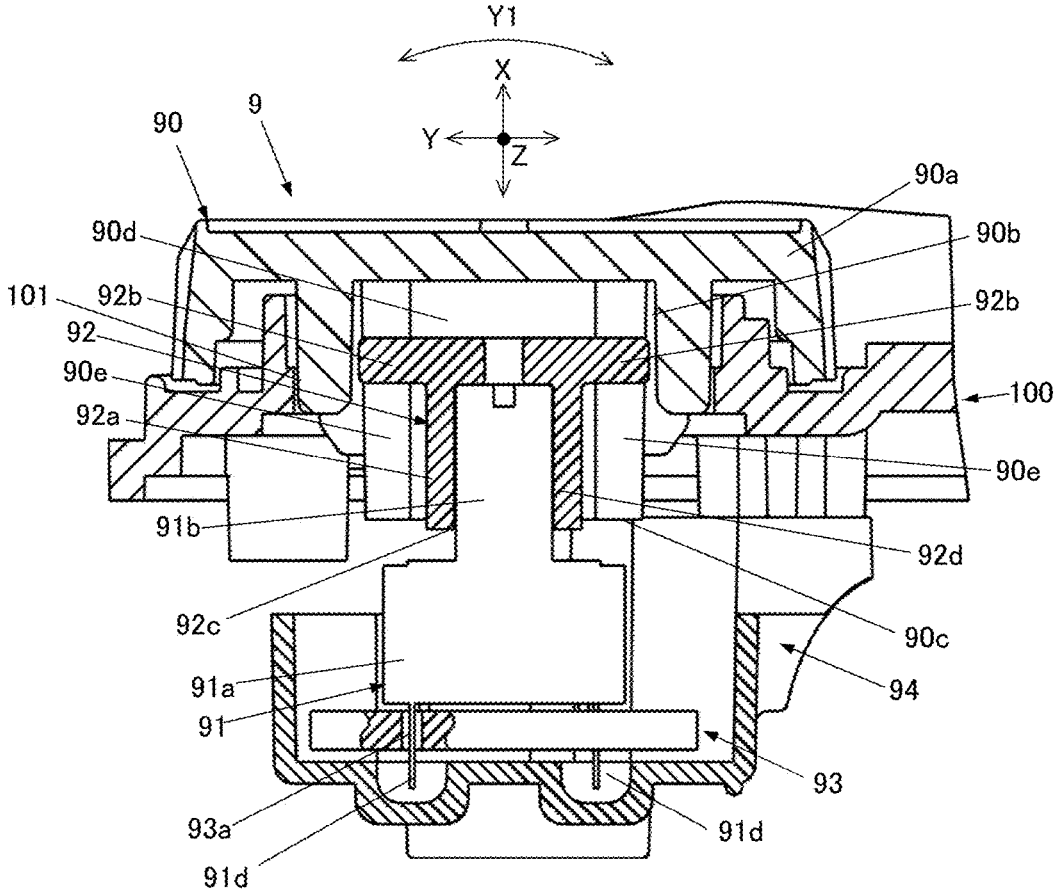
FIG. 5A is a side sectional view illustrating the example of the operation unit according to the present embodiment.
Figure 5B:
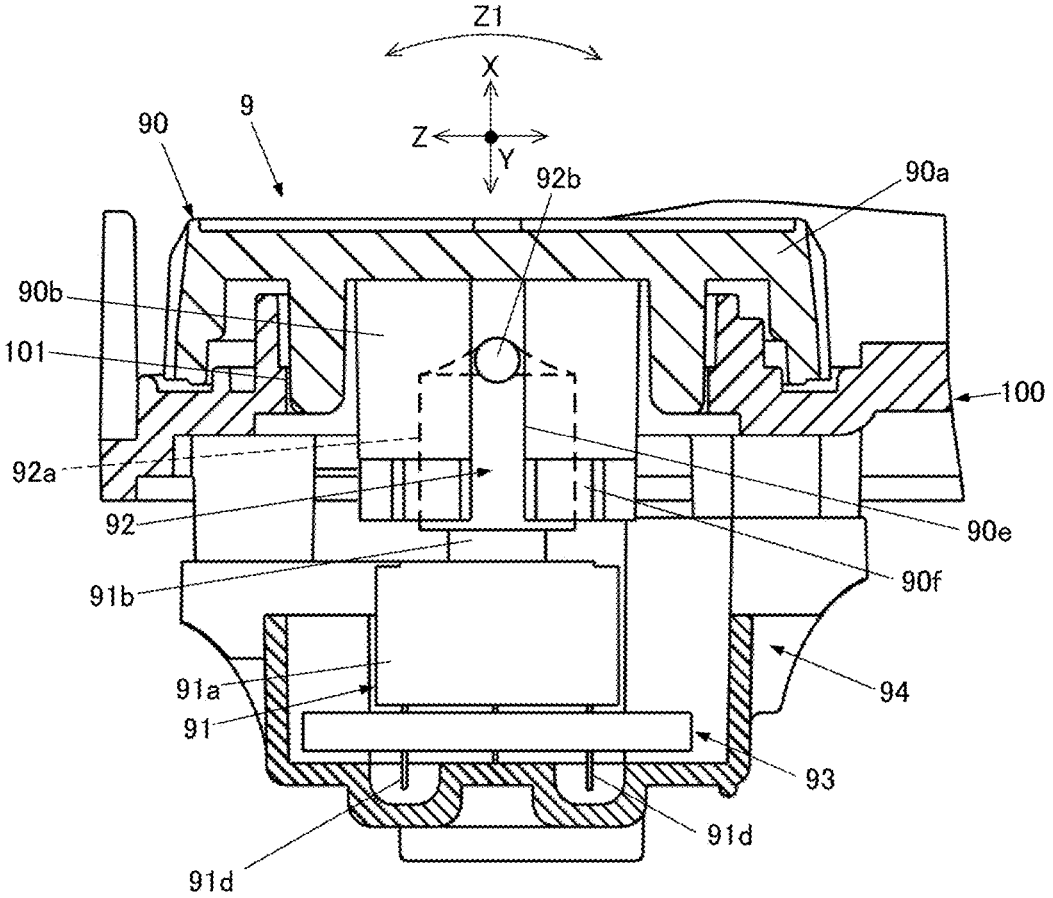
FIG. 5B is a side sectional view illustrating the example of the operation unit according to the present embodiment.

FIG. 3 is an exploded perspective view illustrating an example of an operation unit according to the present embodiment. FIGS. 4A and 4B are exploded perspective views of main portions illustrating the example of the operation unit according to the present embodiment. FIGS. 5A and 5B are side sectional views illustrating the example of the operation unit according to the present embodiment.

Hereinafter, an example of the operation unit 9 according to the present embodiment will be described with reference to the drawings. The operation unit 9 includes an operation dial 90, a rotary switch 91, a connecting portion 92, a substrate 93, and a case 94. In the present embodiment, the operation dial 90 is disposed on an opposite side to the binding unit 7 across the handle 11, as an example.

The operation dial 90 includes a dial 90*a* and a connected portion 90*b*. The dial 90*a* has a shape for receiving an operation of rotating the operation dial 90, and has, for example, a circular outer shape. The operation dial may be configured to receive the operation of stepwisely rotating the operation dial.

The connected portion 90*b* protrudes from a back surface of the dial 90*a* along an axial direction of the rotation of the operation dial 90. The connected portion 90*b* has a substantially cylindrical shape in which an end 90*c* in an axial direction that protrudes from the back surface of the dial 90*a* is opened. The connected portion 90*b* is formed with a hole 90*d* that extends continuously from the opening of the end 90*c* toward the back surface of the dial 90*a* along the axial direction.

The connected portion 90*b* includes grooves 90*e* in two positions facing each other in a radial direction. The groove 90*e* runs from an outer peripheral surface of the connected portion 90*b* to the hole 90*d*. The groove 90*e* extends in the axial direction of the operation dial 90 and is continuous to the end 90*c*.

The connected portion 90*b* includes a rotation angle restrictor 90*f*. The rotation angle restrictor 90*f* is provided with concave portions and convex portions along a circumferential direction on an outer peripheral surface of the connected portion 90*b*. The rotation angle restrictor 90*f* engages with an elastic member (not illustrated) provided on a rear cover 100. Accordingly, the operation dial 90 provides a clicking sensation in the operation of rotating the operation dial 90 in a state in which a rotation angle during rotation is restricted according to a concave-convex pitch of the rotation angle restrictor 90*f*.

The operation dial 90 includes locking portions 90*g*. The locking portions 90*g* are provided in a plurality of positions along the circumferential direction of the rotation of the operation dial 90 outward of the connected portion 90*b* along the radial direction of the operation dial 90. The locking portions 90*g* protrude from the back surface of the dial 90*a* along the axial direction of the rotation of the operation dial 90. Each of the locking portions 90*g* includes, at an end in the axial direction that protrudes from the back surface of the dial 90*a*, a convex portion 90*h* protruding outward along the radial direction of the operation dial 90.

The rear cover 100 is an example of a body cover, and is attached to the body 10 of the reinforcing bar binding machine 1A. In other words, the rear cover 100 is attached on a rear side of the reinforcing bar binding machine 1A in the body cover. The rear cover 100 forming a part of an exterior of the reinforcing bar binding machine 1A is formed with a hole 101 having a diameter for accommodating a virtual circle connecting the multiple locking portions 90*g* arranged side by side in the circumferential direction, and a locked surface 102 to which the convex portions 90*h* of the locking portions 90*g* are locked along an edge of the hole 101. In the present embodiment, the operation dial 90 is disposed to be recessed inward the reinforcing bar binding machine 1A from the body cover (the rear cover 100).

In the operation dial 90, when the connected portion 90*b* and the locking portions 90*g* are inserted into the hole 101 of the rear cover 100, the locking portions 90*g* elastically deform, the convex portions 90*h* climb over the edge of the hole 101, and the convex portions 90*h* are locked to the locked surface 102. Accordingly, the operation dial 90 is rotatably supported by the rear cover 100 such that the locking portions 90*g* are movable along the edge of the hole 101. A rotation center of the operation dial 90 is substantially aligned with a center of the hole 101. Accordingly, the rotation center of the operation dial 90 is defined by the rear cover 100.

The rotary switch 91 includes a switch body 91*a* and a shaft 91*b* rotatable relative to the switch body 91*a*. The switch body 91*a* includes a mechanism in which connection between internal terminals (not illustrated) is switched by rotation of the shaft 91*b*. The shaft 91*b* has a columnar shape and rotates in the circumferential direction. The shaft 91*b* protrudes from the switch body 91*a* in the axial direction. The shaft 91*b* is formed with a groove 91*c* extending along the axial direction in an outer peripheral surface. The switch body 91*a* is provided with external terminals 91*d* on a surface opposite to a surface from which the shaft 91*b* protrudes.

The connecting portion 92 includes a switch connecting portion 92*a* and dial connecting portions 92*b*. The switch connecting portion 92*a* has a substantially cylindrical shape in which one end 92*c* in the axial direction is opened. The substantially cylindrical switch connecting portion 92*a* has an outer diameter smaller than an inner diameter of the hole 90*d* of the connected portion 90*b* of the operation dial 90, and can be inserted into the hole 90*d*.

The switch connecting portion 92*a* is formed with a hole 92*d* that is continuous from the opening of the end 92*c* in the axial direction. In the switch connecting portion 92*a*, the substantially cylindrical hole 92*d* has an inner diameter that is substantially the same as or slightly larger than an outer diameter of the shaft 91*b* of the rotary switch 91, into which the shaft 91*b* can be inserted.

The switch connecting portion 92*a* includes a convex portion 92*e* extending along the axial direction on an inner surface of the hole 92*d*. The convex portion 92*e* has a shape of protruding from the inner peripheral surface of the hole 92*d* inward in the radial direction by a prescribed height and entering the groove 91*c* of the shaft 91*b* of the rotary switch 91.

The height of the convex portion 92*e* protruding inward in the radial direction from the inner peripheral surface of the hole 92*d* is dimensioned to enter the groove 91*c* in a state in which the shaft 91*b* of the rotary switch 91 is inserted into the hole 92*d* of the switch connecting portion 92*a*. Accordingly, the connecting portion 92 is restricted from freely rotating in the circumferential direction relative to the shaft 91*b* of the rotary switch 91.

The dial connecting portion 92*b* protrudes outward in the radial direction of the switch connecting portion 92*a* from an outer peripheral surface of the switch connecting portion 92*a*. The dial connecting portion 92*b* is provided on the other end of the switch connecting portion 92*a* in the axial direction, and protrudes outward from at least two positions facing each other in the radial direction of the switch connecting portion 92*a*. The dial connecting portion 92*b* is a columnar protrusion having an outer diameter smaller than a width of the groove 90*e* of the connected portion 90*b* of the operation dial 90.

A height of the dial connecting portion 92*b* protruding outward in the radial direction from the outer peripheral surface of the switch connecting portion 92*a* is dimensioned to enter the groove 90*e* in a state in which the connecting portion 92 is inserted into the hole 90*d* of the connected portion 90*b* of the operation dial 90.

The substrate 93 is fixed to the case 94 with a screw or the like (not illustrated), and is sealed with a resin (not illustrated). The external terminals 91*d* of the rotary switch 91 are inserted into through holes 93*a* of the substrate 93, and electrical connection and fixation are performed by soldering. A part of the switch body 91*a* of the rotary switch 91 may also be sealed with a resin and fixed to the substrate 93 in a state in which the shaft 91*b* is rotatable. The case 94 is fixed to the rear cover 100 with screws 94*a*.

Examples of Operational Effects of Operation Unit According to Present Embodiment The connecting portion 92 is attached to the shaft 91*b* of the rotary switch 91. The shaft 91*b* is inserted into the hole 92*d* of the switch connecting portion 92*a* of the connecting portion 92. When the shaft 91*b* is inserted into the hole 92*d*, the convex portion 92*e* of the hole 92*d* enters the groove 91*c* of the shaft 91*b*. Accordingly, the connecting portion 92 is restricted from freely rotating in the circumferential direction relative to the shaft 91*b* of the rotary switch 91.

The operation dial 90 is attached to the rear cover 100. When the connected portion 90*b* and the locking portions 90*g* are inserted into the hole 101 of the rear cover 100, the operation dial 90 is rotatably supported by the rear cover 100.

When the case 94 is attached to the rear cover 100 in a state in which the connecting portion 92 is attached to the shaft 91*b* of the rotary switch 91, the connecting portion 92 is inserted into the hole 90*d* of the operation dial 90. The groove 90*e* of the operation dial 90 is continuous to the end 90*c* of the connected portion 90*b*. Accordingly, when the connecting portion 92 is inserted into the hole 90*d* of the operation dial 90, the dial connecting portion 92*b* of the connecting portion 92 is inserted into the groove 90*e* of the operation dial 90.

When the operation dial 90 is rotated in a state in which the dial connecting portion 92*b* of the connecting portion 92 is inserted into the groove 90*e* of the operation dial 90, a force for rotating the operation dial 90 is transmitted to the connecting portion 92 via the groove 90*e* and the dial connecting portion 92*b*.

Further, when the connecting portion 92 rotates, a force for rotating the connecting portion 92 is transmitted to the shaft 91*b* via the convex portion 92*e* provided in the hole 92*d* of the connecting portion 92 and the groove 91*c* of the shaft 91*b* inserted into the hole 92*d* of the connecting portion 92.

Accordingly, the operation dial 90 is connected to the shaft 91*b* of the rotary switch 91 via the connecting portion 92. When the operation dial 90 is rotated, the shaft 91*b* of the rotary switch 91 is rotated.

An extending direction of the shaft 91*b* is an X axis as illustrated in FIGS. 5A and 5B, an extending direction of the dial connecting portion 92*b* is a Y axis as illustrated in FIG. 5A, and a direction orthogonal to the extending direction of the dial connecting portion 92*b* is a Z axis as illustrated in FIG. 5B. The operation dial 90 and the shaft 91*b* of the rotary switch 91 can relatively rotate within a prescribed angle with the dial connecting portion 92*b* of the connecting portion 92 as a rotation shaft. That is, the operation dial 90 can incline relative to the X axis about the Y axis in an arrow Z1 direction of FIG. 5B. Since the groove 90*e* of the operation dial 90 extends in the axial direction, the dial connecting portion 92*b* of the connecting portion 92 is movable along the groove 90*e*. Accordingly, the operation dial 90 and the shaft 91*b* of the rotary switch 91 can relatively rotate within a prescribed angle also in a direction inclined relative to the direction in which the dial connecting portion 92*b* of the connecting portion 92 extends. That is, the operation dial 90 can incline relative to the X axis about the Z axis in an arrow Y1 direction of FIG. 5A. Accordingly, the operation dial 90 has a degree of freedom of pivoting relative to the switch connecting portion 92*a* of the connecting portion 92 about two axes orthogonal to the direction in which the shaft 91*b* extends. Accordingly, when a direction inclined relative to the direction (X axis) in which the shaft 91*b* extends is a first direction, the operation dial 90 and the shaft 91*b* of the rotary switch 91 can relatively incline within a prescribed angle in a freely selected first direction relative to the direction in which the shaft 91*b* extends.

Further, the operation dial 90 and the shaft 91*b* of the rotary switch 91 can relatively move in a prescribed range in a second direction along a Y-Z plane including the Y axis and the Z axis, which is a direction orthogonal to the direction (X axis) in which the shaft 91*b* extends, due to a difference between the inner diameter of the hole 90*d* of the operation dial 90 and the outer diameter of the connecting portion 92, a difference between the width of the groove 90*e* of the operation dial 90 and the outer diameter of the dial connecting portion 92*b* of the connecting portion 92, and the like. Accordingly, the operation dial 90 has a degree of freedom of moving in a direction orthogonal to the direction in which the shaft 91*b* extends relative to the switch connecting portion 92*a* of the connecting portion 92.

Further, the operation dial 90 and the shaft 91*b* of the rotary switch 91 can relatively move in a prescribed range in a third direction along the X axis that is the direction in which the shaft 91*b* extends.

As described above, the operation dial 90 is rotatably supported by the rear cover 100. In contrast, the rotary switch 91 is fixed to the case 94 via the substrate 93. With such a configuration, when the case 94 is fixed to the rear cover 100, the operation dial 90 and the shaft 91*b* of the rotary switch 91 may relatively incline relative to the axial direction within a prescribed tolerance range. Further, an axial center of the operation dial 90 and an axial center of the shaft 91*b* of the rotary switch 91 may relatively deviate within a prescribed range in the direction orthogonal to the direction in which the shaft 91*b* extends. The operation dial 90 and the shaft 91*b* of the rotary switch 91 may further relatively deviate in the axial direction within a prescribed range.

In contrast, in the operation unit 9, the operation dial 90 is connected to the shaft 91*b* of the rotary switch 91 via the connecting portion 92. The connecting portion 92 connects the operation dial 90 and the shaft 91*b* of the rotary switch 91 such that the operation dial 90 and the shaft 91*b* of the rotary switch 91 are relatively movable in the first direction inclined relative to the direction in which the shaft 91*b* extends, the second direction orthogonal to the direction in which the shaft 91*b* extends, and the third direction along the direction in which the shaft 91*b* extends.

Accordingly, the connecting portion 92 of the operation unit 9 can absorb deviations and inclinations between the axial centers of the operation dial 90 and the rotary switch 91. Accordingly, assembly is possible even when the axial center of the rotary switch 91 deviates from the axial center of the operation dial 90. Assembly is also possible even when the shaft 91*b* of the rotary switch 91 and the operation dial 90 are not perpendicular.

Further, a load can be prevented from being applied to the shaft 91*b* of the rotary switch 91 even when the axial center of the rotary switch 91 deviates from the axial center of the operation dial 90. A load can be also prevented from being applied to the shaft 91*b* of the rotary switch 91 even when the shaft 91*b* of the rotary switch 91 and the operation dial 90 are not perpendicular.

Accordingly, when the case 94 is fixed to the rear cover 100, an error in an output of the rotary switch 91 due to a load applied to the shaft 91*b* of the rotary switch 91 can be prevented. In addition, since the rotation angle of the operation dial 90 during rotation is restricted in accordance with the concave-convex pitch of the rotation angle restrictor 90*f*, even in a state in which the shaft 91*b* has a degree of freedom of moving in the directions described above, the operation dial 90 can provide a clicking sensation in the operation of rotating the operation dial 90 without giving the operator a sense of looseness.

In the above embodiment, the dial connecting portion 92*b* protrudes outward from at least two positions facing each other in the radial direction of the switch connecting portion 92*a*. In contrast, the dial connecting portion 92*b* may be provided in three or more positions in the circumferential direction of the switch connecting portion 92*a*. With such a configuration, the groove 90*e* of the operation dial 90 is provided in accordance with an arrangement and number of the dial connecting portion 92*b*.

Further, in the above embodiment, the connecting portion 92 includes the dial connecting portion 92*b* that is a protrusion protruding in the radial direction intersecting with the extending direction of the shaft 91*b*, and the operation dial 90 includes the groove 90*e* into which the dial connecting portion 92*b* is inserted. In contrast, the operation dial 90 may include a protrusion protruding in the radial direction intersecting the direction in which the shaft 91*b* extends, and the connecting portion 92 may include a groove into which the protrusion is inserted. Further, the connecting portion 92 may be integrally provided on the shaft 91*b* of the rotary switch 91.

Operation Example of Reinforcing Bar Binding Machine According to Present Embodiment Next, an operation of binding the reinforcing bars S with the wires W by the reinforcing bar binding machine 1A according to the present embodiment will be described with reference to the drawings.

When the reinforcing bars S are inserted to between the curl guide 50 and the introducing guide 51 of the curl forming unit 5 and the trigger 12 is operated, the feeding motor (not illustrated) is driven in the forward rotation direction, and the two wires W sandwiched between the pair of feeding gears 30 are fed in the forward direction indicated by the arrow F.

The wires W fed in the forward direction are fed to the curl guide 50 of the curl forming unit 5. By passing through the curl guide 50, the wires W are curled to be wound around the reinforcing bars S along the annular feeding path Ru.

The wires W curled by the curl guide 50 is introduced to the introducing guide 51, and is further fed in the forward direction by the wire feeder 3, thereby being introduced to the wire locking body 70. When the distal ends of the wires W are fed to a position abutting against the feeding restrictor 16, driving of the feeding motor (not illustrated) is stopped.

After the wires W are stopped from being fed in the forward direction, the motor 80 is driven in the forward rotation direction. The sleeve 71 is restricted from rotating in an operation range in which the wires W are locked by the wire locking body 70. Accordingly, rotation of the motor 80 is converted into linear movement, and the sleeve 71 moves in an arrow A1 direction that is a forward direction. When the sleeve 71 moves in the forward direction, the wires W are locked by a predetermined operation of the wire locking body 70.

After the sleeve 71 is advanced to a position where the wires W are locked by the wire locking body 70, the rotation of the motor 80 is temporarily stopped, and the feeding motor is driven in the reverse rotation direction.

Accordingly, the pair of feeding gears 30 are rotated in the reverse direction, and the wires W sandwiched between the pair of feeding gears 30 are fed in the reverse direction indicated by the arrow R. In the operation of feeding the wires W in the reverse direction, the wires W are wound around the reinforcing bars S.

After the wires W are wound around the reinforcing bars S and the driving of the feeding motor in the reverse rotation direction is stopped, the motor 80 is driven in the forward rotation direction, so that the sleeve 71 further moves in the forward direction indicated by an arrow A1. When the movement of the sleeve 71 in the forward direction is transmitted to the cutter 6 by the transmission mechanism 62, the movable blade 61 rotates, and a prescribed position of the wires W is cut by the operation of the fixed blade 60 and the movable blade 61.

When the motor 80 is driven in the forward rotation direction, the wires W are pressed in the forward direction by the wire locking body 70 almost at the same time as when the sleeve 71 is moved in the forward direction indicated by the arrow A1 and the two wires W are cut, and distal end sides and end sides of the wires W are bent on a reinforcing bar S side.

After the distal end sides and the end sides of the wires W are bent on the reinforcing bar S side, the motor 80 is further driven in the forward rotation direction, so that the sleeve 71 further moves in the forward direction. When the sleeve 71 moves to a predetermined position, rotation restriction of the sleeve 71 is released.

Accordingly, the sleeve 71 rotates when the motor 80 is further driven in the forward rotation direction, and the wires W locked by the wire locking body 70 start to be twisted. When a load applied to the motor 80 is detected to be maximized by twisting the wires W, the forward rotation of the motor 80 is stopped. Next, when the motor 80 is driven in the reverse rotation direction, the sleeve 71 moves in an arrow A2 direction which is a rearward direction in a state of being restricted from rotating.

When the sleeve 71 moves in the rearward direction, the wires W are released from being locked by the wire locking body 70, and the wires W binding the reinforcing bars S come out of the wire locking body 70.

In the reinforcing bar binding machine 1A, the shaft 91*b* of the rotary switch 91 is rotated by rotating the operation dial 90 with the operation unit 9. A control unit (not illustrated) of the reinforcing bar binding machine 1A controls a rotation amount of the motor 80 according to the rotation angle of the shaft 91*b* of the rotary switch 91. Accordingly, the magnitude of the binding force for twisting and binding the wires W can be set.

What is claimed is:

1. A binding machine comprising:

an operation dial configured to receive an operation of rotating the operation dial;

a rotary switch having a rotatable shaft; and a connecting portion connecting the shaft and the operation dial such that the shaft is rotatable, the connecting portion supporting the operation dial such that a posture of the operation dial is changeable with respect to an extending direction (X) of the shaft, wherein:

the operation dial includes: a dial having a shape for receiving an operation of rotating the operation dial; and a connected portion having a substantially cylindrical shape with an opened end protruding from a back surface of the dial along an axial direction of the rotation of the operation dial, the connected portion includes: a hole extending continuously from the opened end toward the back surface of the dial along the axial direction; and a groove extending along the extending direction (X) of the shaft and into which a dial connecting portion of the connecting portion is inserted, the connecting portion includes a switch connecting portion insertable into the hole, and the switch connecting portion has a substantially cylindrical shape with an opened end in the axial direction thereof, and an outer diameter smaller than an inner diameter of the hole of the connected portion, the dial connecting portion has an outer diameter smaller than a width of the groove of the operation dial and protrudes in a radial direction intersecting the extending direction (X) of the shaft, and the operation dial has:

a degree of freedom in pivoting, with respect to the switch connecting portion, about two axes (Y, Z), one direction (Y) of which is the extending direction of the dial connecting portion, and the other direction (Z) of which is a direction orthogonal to the extending direction (X) of the shaft and the extending direction (Y) of the dial connecting portion; and a degree of freedom in moving in a direction orthogonal to the extending direction (X) of the shaft with respect to the switch connecting portion.

2. The binding machine according to claim 1, wherein the dial connecting portion is provided at least in two positions facing each other in the radial direction of the switch connecting portion.

3. The binding machine according to claim 1, wherein the switch connecting portion is connected to the shaft and extends along the extending direction (X) of the shaft.

4. The binding machine according to claim 1, wherein the operation dial is rotatably supported by a body cover, and the rotary switch is supported by a case attached to the body cover.

5. The binding machine according to claim 1, further comprising:

a handle configured to be held by an operator in a hand; and a binding unit configured to twist a wire wound around an object to be bound, wherein the operation dial is disposed on an opposite side to the binding unit across the handle.

6. The binding machine according to claim 1, further comprising:

a body cover that forms a part of an exterior of the binding machine, wherein the operation dial is disposed to be recessed inward the binding machine from the body cover.

7. The binding machine according to claim 6, further comprising:

a handle configured to be held by an operator in a hand; and a binding unit configured to twist a wire wound around an object to be bound, wherein the body cover includes a rear cover disposed on an opposite side to the binding unit across the handle, and the operation dial is provided on the rear cover.

8. The binding machine according to claim 1, wherein the operation dial is configured to receive the operation of stepwisely rotating the operation dial.

* * * * *